US009243426B2

(12) United States Patent
Gerlings et al.

(10) Patent No.: US 9,243,426 B2
(45) Date of Patent: Jan. 26, 2016

(54) MULTI-PIECE KEY ASSEMBLY

(71) Applicant: The Hillman Group Inc., Cincinnati, OH (US)

(72) Inventors: Phillip Gerlings, Chandler, AZ (US); Michael James Schmidt, Queen Creek, AZ (US)

(73) Assignee: The Hillman Group, Inc., Cincinnati, OH (US)

( * ) Notice: Subject to any disclaimer, the term of this patent is extended or adjusted under 35 U.S.C. 154(b) by 0 days.

(21) Appl. No.: 14/508,679

(22) Filed: Oct. 7, 2014

(65) Prior Publication Data

US 2015/0047399 A1 Feb. 19, 2015

Related U.S. Application Data

(63) Continuation-in-part of application No. 14/252,412, filed on Apr. 14, 2014.

(60) Provisional application No. 61/866,603, filed on Aug. 16, 2013, provisional application No. 61/904,810, filed on Nov. 15, 2013.

(51) Int. Cl.

| | |
|---|---|
| ***E05B 19/04*** | (2006.01) |
| ***E05B 19/00*** | (2006.01) |
| *E05B 19/24* | (2006.01) |

(52) U.S. Cl.

CPC ..... *E05B 19/04* (2013.01); *E05B 19/0017* (2013.01); *E05B 19/24* (2013.01); *Y10T 70/7876* (2015.04)

(58) Field of Classification Search

CPC ..... E05B 19/04; E05B 19/00; E05B 19/002; G07C 2009/00984; A45C 13/1076; A44B 15/005; F16G 15/06; A44C 5/0038

USPC ..... 70/408, 456 R

See application file for complete search history.

(56) References Cited

U.S. PATENT DOCUMENTS

| | | | | | |
|---|---|---|---|---|---|
| 3,729,965 | A | * | 5/1973 | Gartner | 70/395 |
| 3,780,550 | A | * | 12/1973 | Simorghi | 70/395 |
| 3,797,291 | A | * | 3/1974 | Simorghi | 70/395 |
| 3,841,120 | A | * | 10/1974 | Gartner | 70/395 |
| 3,895,508 | A | * | 7/1975 | Crasnianski | 70/395 |

(Continued)

FOREIGN PATENT DOCUMENTS

| | | |
|---|---|---|
| EP | 13358732 | 8/2003 |
| EP | 2000303 | 12/2008 |

(Continued)

OTHER PUBLICATIONS

Phillip Gerlings, U.S. Appl. No. 14/263,551 entitled "Fabrication System for Key Making Machine" filed Apr. 28, 2014.

(Continued)

*Primary Examiner* — Suzanne Barrett

(74) *Attorney, Agent, or Firm* — Finnegan, Henderson, Farabow, Garrett & Dunner LLP

(57) ABSTRACT

A key assembly is disclosed. The key assembly may have a blade, and a head configured to receive the blade. The key assembly may also have a locking feature separate from the blade and the head. The locking feature may be received by the head and configured to inhibit removal of the blade from the head via interference. The locking feature may deform during connection to the blade.

58 Claims, 8 Drawing Sheets

(56) References Cited

U.S. PATENT DOCUMENTS

| | | | | |
|---|---|---|---|---|
| 3,950,973 | A * | 4/1976 | Grasnianski | 70/395 |
| 4,102,166 | A * | 7/1978 | Hughes | 70/456 R |
| 4,235,087 | A | 11/1980 | Bianchi | |
| 4,312,200 | A * | 1/1982 | Thomas | 70/408 |
| 4,631,943 | A * | 12/1986 | Hoener | 70/395 |
| 4,666,351 | A | 5/1987 | Marchal | |
| 4,899,391 | A | 2/1990 | Cimino et al. | |
| 4,901,548 | A | 2/1990 | Deslandes | |
| 5,038,590 | A * | 8/1991 | Sawyer et al. | 70/458 |
| 5,083,662 | A * | 1/1992 | Bishop et al. | 206/37.1 |
| 5,167,171 | A | 12/1992 | Heredia | |
| 5,351,409 | A | 10/1994 | Heredia | |
| 5,383,345 | A | 1/1995 | Kallinger et al. | |
| 5,538,374 | A | 7/1996 | Cole et al. | |
| 5,546,316 | A | 8/1996 | Buckley et al. | |
| 5,556,240 | A | 9/1996 | Almblad | |
| 5,569,003 | A | 10/1996 | Goldman et al. | |
| 5,607,267 | A | 3/1997 | Heredia et al. | |
| 5,660,509 | A | 8/1997 | Cole et al. | |
| 5,676,504 | A | 10/1997 | Mueller et al. | |
| 5,739,766 | A | 4/1998 | Chaloux | |
| 5,764,156 | A | 6/1998 | Chaloux | |
| 5,807,042 | A | 9/1998 | Almblad et al. | |
| 5,833,406 | A | 11/1998 | Chies et al. | |
| 5,844,808 | A | 12/1998 | Konsmo et al. | |
| 5,870,917 | A * | 2/1999 | Mahot et al. | 70/408 |
| 5,906,365 | A | 5/1999 | Wu | |
| 5,908,273 | A | 6/1999 | Titus et al. | |
| 5,951,218 | A | 9/1999 | Wu | |
| 5,956,985 | A | 9/1999 | Chang | |
| 5,964,554 | A | 10/1999 | Drori | |
| 5,974,844 | A | 11/1999 | Harrelson et al. | |
| 5,997,224 | A | 12/1999 | Beauregard et al. | |
| 6,064,747 | A | 5/2000 | Wills et al. | |
| 6,065,911 | A | 5/2000 | Almblad et al. | |
| 6,089,060 | A * | 7/2000 | Steeley | 70/456 R |
| 6,106,131 | A | 8/2000 | Hao | |
| 6,152,662 | A | 11/2000 | Titus et al. | |
| 6,185,311 | B1 | 2/2001 | Yanovsky et al. | |
| 6,237,756 | B1 | 5/2001 | Caudle | |
| 6,308,542 | B1 * | 10/2001 | Bolton | 70/408 |
| 6,371,286 | B1 | 4/2002 | Montanari | |
| 6,406,227 | B1 | 6/2002 | Titus et al. | |
| 6,427,504 | B1 * | 8/2002 | Janssen et al. | 70/278.3 |
| 6,449,381 | B1 | 9/2002 | Yanovsky et al. | |
| 6,543,972 | B1 | 4/2003 | Cimino | |
| D475,195 | S | 6/2003 | Christianson | |
| 6,588,995 | B2 | 7/2003 | Wills et al. | |
| 6,595,045 | B1 | 7/2003 | Fuglewicz et al. | |
| 6,602,030 | B1 | 8/2003 | Markbreit | |
| 6,641,339 | B2 | 11/2003 | Chies et al. | |
| 6,647,308 | B1 | 11/2003 | Prejean | |
| 6,684,673 | B2 | 2/2004 | Florendo | |
| 6,782,725 | B2 | 8/2004 | Linares | |
| 6,801,829 | B2 | 10/2004 | Kawai | |
| 6,839,449 | B1 | 1/2005 | Campbell et al. | |
| 6,892,558 | B2 | 5/2005 | Chodosh | |
| 6,895,100 | B1 | 5/2005 | Pacenzia et al. | |
| 7,055,352 | B2 | 6/2006 | Meyerson et al. | |
| 7,077,607 | B2 | 7/2006 | Foscan | |
| 7,167,892 | B2 | 1/2007 | Defossé et al. | |
| 7,214,011 | B2 | 5/2007 | Ryai, Sr. et al. | |
| 7,380,428 | B2 | 6/2008 | Morehart et al. | |
| 7,387,476 | B2 | 6/2008 | Ryai, Sr. | |
| 7,527,458 | B2 | 5/2009 | Ryai, Sr. et al. | |
| D618,983 | S | 7/2010 | Downes | |
| 7,849,721 | B2 * | 12/2010 | Bass et al. | 70/408 |
| 7,890,878 | B2 | 2/2011 | Bass et al. | |
| 7,891,919 | B2 | 2/2011 | Bass et al. | |
| 7,918,629 | B2 | 4/2011 | Belflower et al. | |
| 8,074,481 | B2 | 12/2011 | Bass et al. | |
| 8,126,764 | B2 | 2/2012 | Murray et al. | |
| 8,128,322 | B2 | 3/2012 | Bass et al. | |
| 8,142,117 | B2 | 3/2012 | Belflower et al. | |
| 8,191,779 | B2 | 6/2012 | Illingworth et al. | |
| 8,214,247 | B2 | 7/2012 | Murray et al. | |
| 8,215,625 | B2 | 7/2012 | Wu | |
| 8,225,696 | B2 | 7/2012 | Downes | |
| 8,287,215 | B2 | 10/2012 | Freeman et al. | |
| 8,292,556 | B2 | 10/2012 | Ryai, Sr. et al. | |
| D674,590 | S | 1/2013 | Busch | |
| 8,342,783 | B2 | 1/2013 | Ryai, Sr. | |
| 8,373,558 | B2 | 2/2013 | Sagady et al. | |
| 8,484,068 | B2 | 7/2013 | Godwin et al. | |
| 8,484,070 | B2 | 7/2013 | Murray et al. | |
| 8,532,809 | B2 | 9/2013 | Freeman | |
| 8,600,546 | B1 | 12/2013 | Hagen et al. | |
| 8,634,951 | B2 | 1/2014 | Freeman | |
| 2003/0209044 | A1 * | 11/2003 | Plate et al. | 70/408 |
| 2004/0148988 | A1 * | 8/2004 | Taylor | 70/408 |
| 2004/0253067 | A1 | 12/2004 | Bosch | |
| 2005/0241353 | A1 * | 11/2005 | Moening | 70/408 |
| 2006/0048553 | A1 * | 3/2006 | Almquist | 70/406 |
| 2006/0090528 | A1 | 5/2006 | Moening | |
| 2007/0006621 | A1 * | 1/2007 | Doong | 70/409 |
| 2008/0127693 | A1 * | 6/2008 | Cadiz et al. | 70/456 R |
| 2009/0228795 | A1 | 9/2009 | Bass et al. | |
| 2010/0052234 | A1 | 3/2010 | Ryai, Sr. | |
| 2010/0278437 | A1 | 11/2010 | Thompson et al. | |
| 2010/0278438 | A1 | 11/2010 | Thompson et al. | |
| 2010/0316250 | A1 | 12/2010 | Perrigo | |
| 2011/0110741 | A1 | 5/2011 | Huss et al. | |
| 2011/0167377 | A1 | 7/2011 | Bass et al. | |
| 2011/0176861 | A1 | 7/2011 | Nakayama et al. | |
| 2011/0262240 | A1 | 10/2011 | Mutch et al. | |
| 2011/0297691 | A1 | 12/2011 | Freeman | |
| 2011/0301738 | A1 | 12/2011 | Freeman | |
| 2012/0014762 | A1 | 1/2012 | Ryai, Sr. et al. | |
| 2012/0038453 | A1 | 2/2012 | Bass et al. | |
| 2012/0153027 | A1 * | 6/2012 | Dawber | 235/492 |
| 2012/0154127 | A1 | 6/2012 | Donadini | |
| 2012/0213603 | A1 | 8/2012 | Bass et al. | |
| 2012/0243957 | A1 | 9/2012 | Drake et al. | |
| 2013/0017030 | A1 | 1/2013 | Freeman et al. | |
| 2013/0039714 | A1 | 2/2013 | Ryai, Sr. et al. | |
| 2013/0094918 | A1 | 4/2013 | Ryai, Sr. | |
| 2013/0283868 | A1 * | 10/2013 | Morehart et al. | 70/447 |

FOREIGN PATENT DOCUMENTS

| | | |
|---|---|---|
| EP | 2517826 | 10/2012 |
| WO | WO 8912867 | 12/1989 |

OTHER PUBLICATIONS

Phillip Gerlings, U.S. Appl. No. 14/263,595 entitled "identification Module for Key Making Machine" filed Apr. 29, 2014.
"Green Curtain Projects Confidential", Dec. 2009.

* cited by examiner

MULTI-PIECE KEY ASSEMBLY

RELATED APPLICATIONS

This application is a continuation-in-part application of U.S. application Ser. No. 14/252,412, filed Apr. 14, 2014 which is a non-provisional application of Provisional No. 61/866,603 filed Aug. 16, 2013 (now expired) and Provisional No. 61/904,810 filed Nov. 15, 2013 (still pending), the contents of which are expressly incorporated herein by reference.

TECHNICAL FIELD

The present disclosure is directed to a key assembly and, more particularly, to a multi-piece key assembly.

BACKGROUND

A master key can be duplicated in any number of different ways, by measuring a profile of the master key and duplicating that profile within a key blank. The key blank generally has a size and shape larger than the master key, so that the key blank can be machined (e.g., cut and/or milled down) to function like the master key. In order to reduce an amount of key blank inventory that a locksmith must keep on hand for duplication purposes, common or universal key blanks may be utilized.

An exemplary key for use in duplication operations is disclosed in U.S. Patent Application Publication No. 2004/0148988 of Taylor that published on Aug. 5, 2004 ("the '988 publication"). Specifically, the '988 publication discloses a metallic blade on which serrations are to be formed, and a key head made of jewelry and having a receiving slot for receiving an inserting portion of the key blade. The key head is fixed to the blade by way of friction, glue, epoxy, or welding, and includes insignia surfaces for decorative design.

Although the key of the '988 publication may be decorative and provide a customer with certain options, it may still be less than optimal. In particular, the head may be expensive to fabricate, difficult to connect to the blade, and inhibit interchangeability of heads. Further, the blade may not be conducive to an automated fabrication process.

The disclosed key assembly is directed to overcoming one or more of the problems set forth above and/or other problems of the prior art.

SUMMARY

In one aspect, the present disclosure is directed to a key assembly. The key assembly may include a blade, and a head configured to receive the blade. The key assembly may also include a locking feature separate from the blade and the head. The locking feature may be received by the head and configured to inhibit removal of the blade from the head via interference. The locking feature may deform during connection to the blade.

In another aspect, the present disclosure is directed to another key assembly. This key assembly may include a blade having a head portion, a shank, a transition region connecting the head portion to the shank, and at least one protrusion located at the transition region. The key assembly may also include a head configured to receive the head portion of the blade and having at least one shoulder configured to engage the at least one protrusion. The key assembly may further include a locking feature separate from the blade and the head. The locking feature may be received by the head and configured to inhibit removal of the blade from the head.

In yet another aspect, the present disclosure is directed to another key assembly. This key assembly may include blade, a head configured to receive the blade, and a locking feature separate from the blade and the head and being received by the head. The locking feature may have at least a first tang configured to engage the blade, and at least a second tang configured to engage the head.

DETAILED DESCRIPTION

Figure 1C:
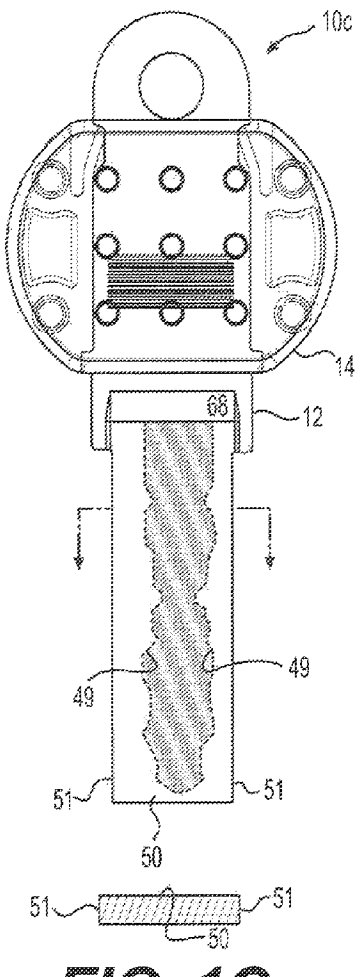
FIGS. 1A-1C are front view and end view illustrations of three different exemplary disclosed key assemblies.
Figure 1B:
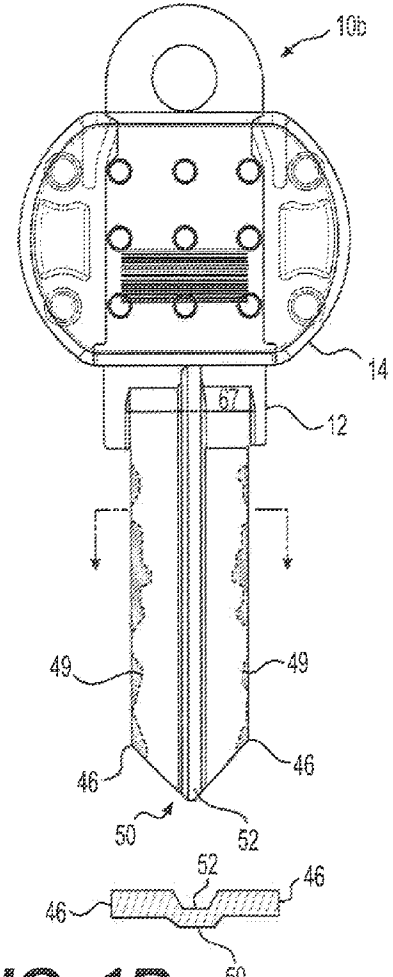
Figure 1A:
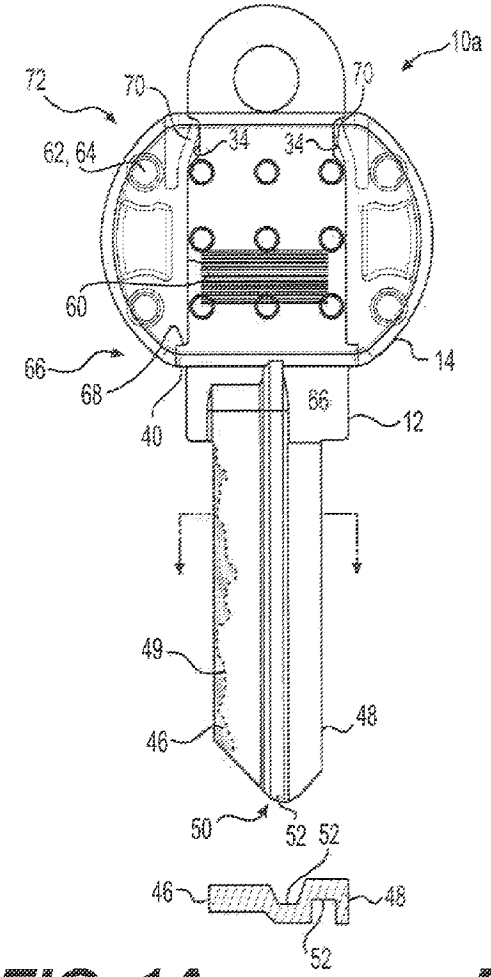

FIGS. 1A-1C illustrate three different exemplary key assemblies 10*a*, 10*b*, and 10*c*, which will collectively be referred to as key assembly 10 in this disclosure. Each key assembly 10 may be used as a means for gaining access to a variety of different secure applications, for example to automotive applications (e.g., door and ignition locks), to residential applications (e.g., dead bolt and handle locks), and to commercial applications (e.g., equipment and facility locks). Each key assembly 10 may generally include a blade 12, and a head 14 that is connected to blade 12. As shown in FIGS. 1A-1C, head 14 is a separate component or subassembly of components that is connected to blade 12 before or after formation of desired features within blade 12. It is contemplated that head 14 may be fixedly or removably, connected to blade 12, as desired. When head 14 is connected to blade 12, one end or both ends (both ends shown in FIGS. 1A-1C) of blade 12 may protrude a distance from head 14. Head 14 may serve as a handle through which a user generates torque within blade 12, causing an associated lock to turn and open or close.

As shown in FIGS. 1A-1C, each of key assemblies 10*a*-10*c* may be a different type of key assembly. In particular, key assembly 10*a* may have a single edge-cut form (shown in FIG. 1A); key assembly 10*b* may have a dual edge-cut form (shown in FIG. 1B); and key assembly 10*c* may have a milled form (shown in FIG. 1C). In general, key assembly 10*a*, having the single edge-cut form, may include blade 12 with a single relatively thinner lengthwise outer edge 46 that is configured to be notched in a particular pattern (shown in phantom lines as notches 49) corresponding to the lock intended to receive blade 12, and a single relatively thicker opposing outer edge 48 that does not include notches 49. Key assembly 10*b* with the dual edge-cut form may have two opposing outer edges 46 that are notched and thinner relative to a thicker center section 50. Center sections 50 within blades 12 of both the single and dual edge-cut key assemblies 10*a*, 10*b* may include one or more channels 52 formed therein, such that an endwise cross-section of each assembly has a general zigzag shape. Key assembly 10*c*, having the milled form, may include relatively thicker square outer edges 51, with a planar center section 50 of about the same thickness (i.e., a cross-section of a milled form may be generally rectangular). Center section 50 of the milled key assembly 10*c* generally has an internal pattern of notches 49 that is milled within center section 50 and located away from edges 51, the pattern being variable and corresponding to the lock intended to receive blade 12.

Figure 2A:
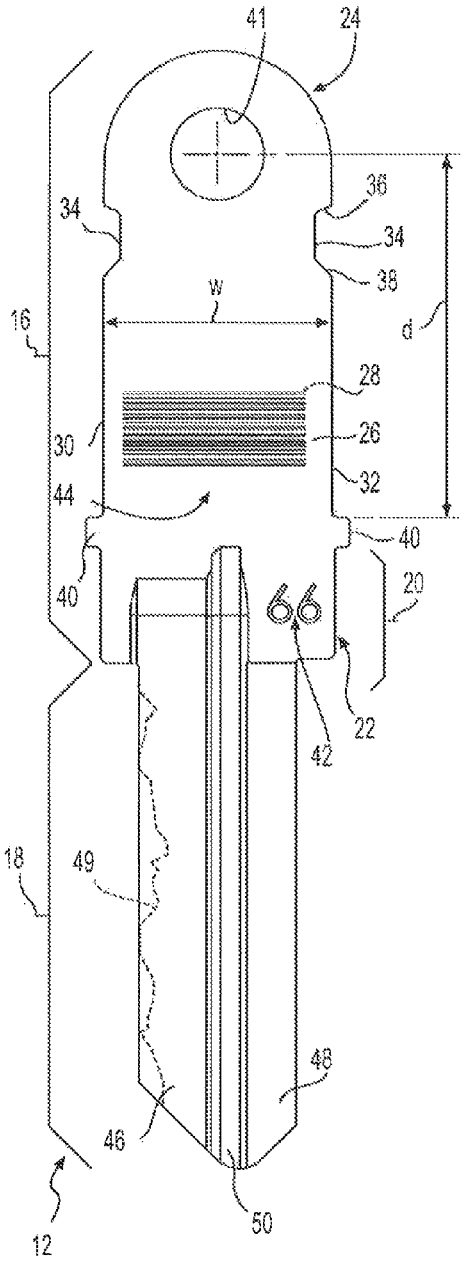
FIGS. 2A-2C are front and side view illustrations of an exemplary disclosed key blade that forms a portion of the key assembly of FIG. 1A.
Figure 2B:
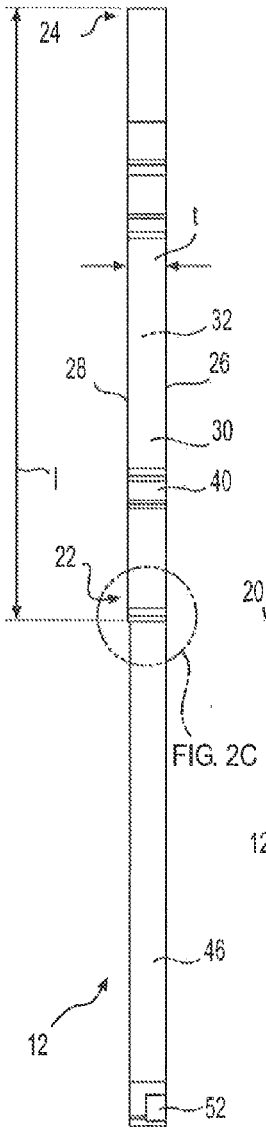
Figure 2C:
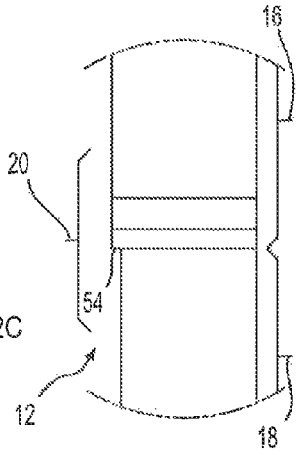

An exemplary blade 12 for single edge-cut key assembly 10*a* is shown in FIGS. 2A-2C. As shown in these figures, blade 12 may include a head portion 16, and a shank 18 that is integrally formed with head portion 16. Head portion 16 may join shank 18 at a transition region 20. In the disclosed embodiment, blade 12 is formed from aluminum, brass, bronze, or another metal alloy through a stamping process and may or may not be painted or otherwise plated with a colored film. It is contemplated, however, that another material and/or process may be utilized to form blade 12, if desired.

Head portion 16 of blade 12 may have geometry designed to interact with corresponding geometry of head 14 (referring to FIGS. 1A-1C). In particular, as shown in FIGS. 2A-2C, head portion 16 may he generally plate-like, having a substantially uniform thickness t along its length l from a square shaped base end 22 within transition region 20 to a rounded tip end 24. In the disclosed embodiment, thickness t between opposing primary surfaces 26, 28 may be about 0.075-0.1 inches (e.g., about 0.08 inches) and length l may be about 1.25-1.5 inches (e.g., about 1.33 inches). Head portion 16 may also have a generally uniform width w between opposing side surfaces 30, 32 of about 0.4-0.5 inches (e.g., about 0.486 inches). These specific dimensions may be selected to produce a slip fit of head portion 16 within an internal cavity of head 14. Head portion 16 may be engaged on its two primary faces 26, 28 and its two substantially perpendicular side surfaces 30, 32 when slidingly received within head 14.

Each head portion 16 may also have geometry designed to inhibit removal of blade 12 from head 14. In particular, one or more recesses 34 may be formed within side surfaces 30, 32 and configured to receive corresponding locking features of head 14. Recesses 34 may have opposing ends 36, 38 that are angled obliquely outward and configured to engage or provide clearance for the locking features, respectively. It is contemplated that the angular orientation of ends 36, 38 may be the same or different, as desired. A pair of shoulders 40 may protrude from side surfaces 30, 32, at a common location between recesses 34 and base end 22. Shoulders 40 may be located a particular distance away from recesses 34 and function as end stops for head 14 during assembly (see FIGS. 1A-1C). Shoulders 40 may also inhibit head 14 from being installed incorrectly (i.e., upside down) onto key blade 12. In some embodiments, a shape, size, and/or position of shoulders 40 may also be used to determine an identity of blade 12 and/or to locate blade 12 during a cutting process, if desired.

In some embodiments, an accessory engagement feature (e.g., an eyelet) 41 may be formed at tip end 24 and configured to engage a separately purchased accessory (e.g., a key ring). In these same embodiments, eyelet 41 may function as an additional or alternative locating feature used during cutting of shank 18, if desired. For example, a center of eyelet 41 may be precisely located a distance d from shoulders 40 and/or from base end 22 (e.g., about 0.7-0.8 inches from shoulders 40). Although tip end 24 is shown as having a generally curved outer periphery that enhances rigidity of head portion 16, it is contemplated that head portion 16 could alternatively have an angled or square outer periphery if desired.

One or more identification indices may be formed within or otherwise applied to head portion 16 and used to identify blade 12 as a particular one of a plurality of known types of key blades. In the disclosed example, two indices are shown, including a first index 42 and a second index 44. Indices 42, 44 may take any form known in the art for relaying information regarding the identity of blade 12, and indices 42, 44 may be the same or different. For example, index 42 may be a type of index readable by a key duplication technician and still visible after head 14 is assembled to blade 12. In the same example, index 44 may be a type of index that is machine readable and visible only before and/or during cutting of shank 18 (i.e., index 44 may be located at a center of where head 14 is to be installed). Examples of different types of indices include alpha-numeric symbols (see index 42 in FIGS. 1A-2A), bar codes (see index 44 in FIGS. 1A-2A), data matrices, QR codes, etc. Although the depicted blade 12 includes indices 42, 44 located at only one side (i.e. only at primary surface 26), it is contemplated that indices 42, 44 could be located at both sides and/or at other positions, if desired.

In some embodiments, shank 18 may have a thickness different than a thickness of head portion 16. In these embodiments, a step 54 (shown only in FIG. 2C) may be located at transition region 20, and transition region 20 may extend from shoulders 40 to base end 22. This step may be the result of a first type of blade 12 having either its head portion 16 or its shank 18 milled thinner after formation through the stamping process discussed above. That is, all blades 12 may need to have a common thickness at head portion 16 to properly receive a common head 14, but blades 12 of different key types may have shanks 18 with a thickness that is the same or different (i.e., thicker or thinner). In situations where shank 18 is required to be thicker than the common head portion thickness, all of blade 12 may be stamped from a thicker material and then head portion 16 may be machined thinner to the common thickness. In contrast, in situations where shank 18 is required to be thinner than the common head portion thickness, all of blade 12 may be stamped from material having the common head thickness, but then shank 18 may be machined thinner. In other words, after stamping of different blades 12, some blades (e.g., the most commonly used blades 12) may be ready for notching (i.e., cutting and/or milling) without further change, while other blades 12 may need to have their head portions 16 or their shanks 18 machined to be thinner, depending on the requirements of the corresponding locks. But in all situations, head portions 16 may have the same thickness when formation of blade 12 is complete. It is contemplated that, in some applications, a length of blade 12 may also need to be shortened during the duplication process.

Figure 3B:
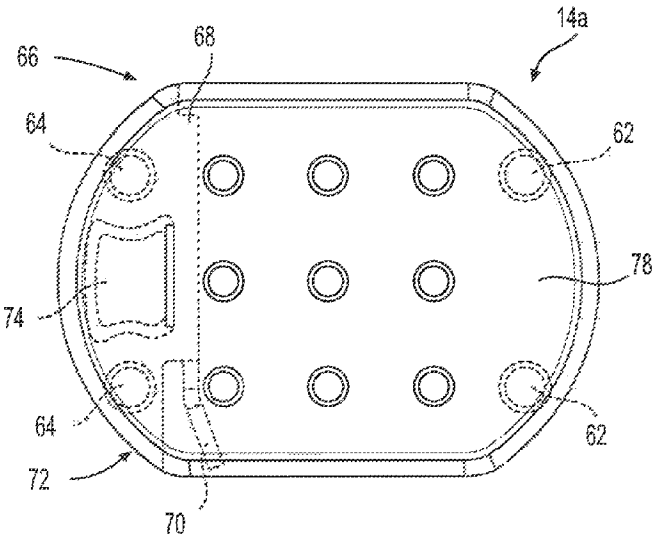
FIGS. 3A-3C are front, back, and side view illustrations of an exemplary disclosed head that receives the key blade of FIGS. 2A-2C to form the key assembly of FIG. 1A.
Figure 3A:
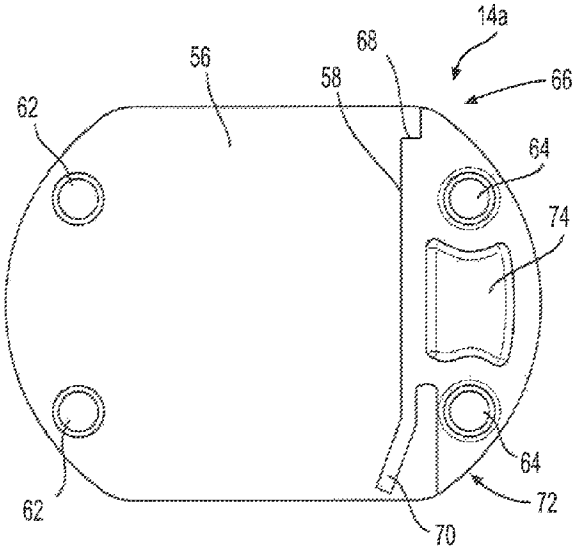
Figure 3C:
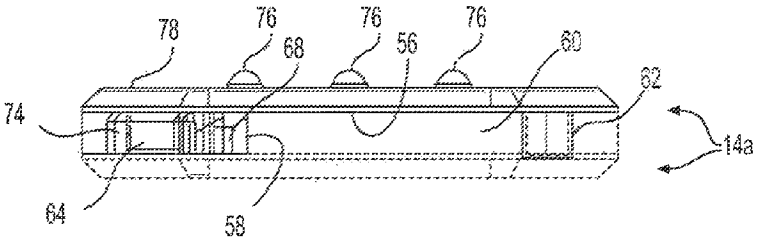

Head 14, in the embodiments of FIGS. 1A-1C, is a subassembly of two substantially identical head components 14*a* oriented in opposition to each other. As shown in FIGS. 3A-3C, each head component 14*a* may include a primary interior surface 56 and a side surface 58 that is substantially perpendicular to primary interior surface 56. When two head components 14*a* are placed together in opposite orientation relative to each other (i.e., with primary interior surfaces 56 facing each other and side surfaces 58 facing each other), a cavity 60 (shown only in FIG. 3C) may be formed that is configured to slidingly receive head portion 16 of blade 12. One or more connecting features may be associated with each head component 14*a* and configured to engage corresponding features in the mating head component 14*a*, thereby maintaining connection between head components 14*a*. For example, one or more pins 62 may protrude at one edge of primary interior surface 56 and be received within one or more corresponding bores 64 located at an opposing edge of primary interior surface 56. Accordingly, when two head components 14*a* are pressed together, four pins 62 (one located at each corner of primary interior surface 56) may enter four bores 64. In some embodiments, removal of pins 62 from bores 64 may be inhibited to thereby prevent unintended disassembly of head 14. Pins 62 may be inhibited from removable by way of an interference fit, an adhesive, or another mechanism known in the art.

In other embodiments, head 14 is a single-piece integral component having many features in common with the two head components 14*a* described above. In these embodiments, the single-piece head 14 includes two primary interior surfaces 56 and two side surface 58 that are substantially perpendicular to primary interior surfaces 56 to form cavity 60. In this arrangement, no subassembly is required and no corresponding connecting features (i.e., pins 62 or bores 64) are formed within head 14.

In either of the two-piece or single-piece embodiments of head 14, a first end 66 of head 14 may be pushed by hand (i.e., without the use of tooling) over tip end 24 of blade 12 and pushed toward shank 18. Two steps 68 may be formed at first end 66 (e.g., one step 68 within each head component 14*a*) and configured to engage shoulder 40 of blade 12 (see FIGS. 1A-1C), thereby positioning head 14 at a desired location along blade 12. Two tangs 70 may be located at a second end 72 of head 14 (e.g., one tang 70 within each head component 14*a*) and configured to deflect (i.e., deform) out of the way of blade 12 (i.e., out of cavity 60) during insertion and then return to a near original position (shown in FIGS. 1A-1C) within recesses 34 of blade 12, thereby mechanically interring with and thereby inhibiting removal of head 14 from blade 12. Each tang 70 may have a proximal end near a center of head 14, and a distal end that protrudes toward second end 72 at an inward angle. The angle of recess end 36 (referring to FIG. 2A) may allow for a secure seating of tang 70 without binding (see FIGS. 1A-1C), while the angle of recess end 38 may provide clearance for the inward intrusion of tang 70. In this configuration, the only way that head 14 could be removed from blade 12 would be to cause buckling or other physical alterations of tangs 70, which would require significant force. In some embodiments, there may not be sufficient space within cavity 60 for tangs 70 to buckle, making removal of head 14 even more difficult, if not impossible, without destruction of head 14.

In the disclosed embodiment, head 14 is injection molded from a plastic material. Accordingly, head 14 (e.g., each head component 14*a*) may have features that facilitate this fabrication method and/or material. For example, a pocket 74 may be formed at a location between bores 64 (if bores 64 are present). Pocket 74 may help to keep all walls of head 14 at about the same thickness, thereby reducing the formation of voids or uneven surfaces during molding. It is contemplated that pocket 74 may be omitted, if desired. It is also contemplated that head 14 could he fabricated from other materials and/or through other processes.

Head 14 may also include features that improve use of key assembly 10. For example, head 14 may include one or more friction-enhancing features, such as raised bumps 76, at an outer surface 78. These features may help to reduce the likelihood of a customer's hand slipping during use of key assembly 10. Head 14 may also have a smooth, rounded periphery that helps to reduce snagging. Head 14 may be fabricated in a variety of colors and/or shapes.

Figure 4:
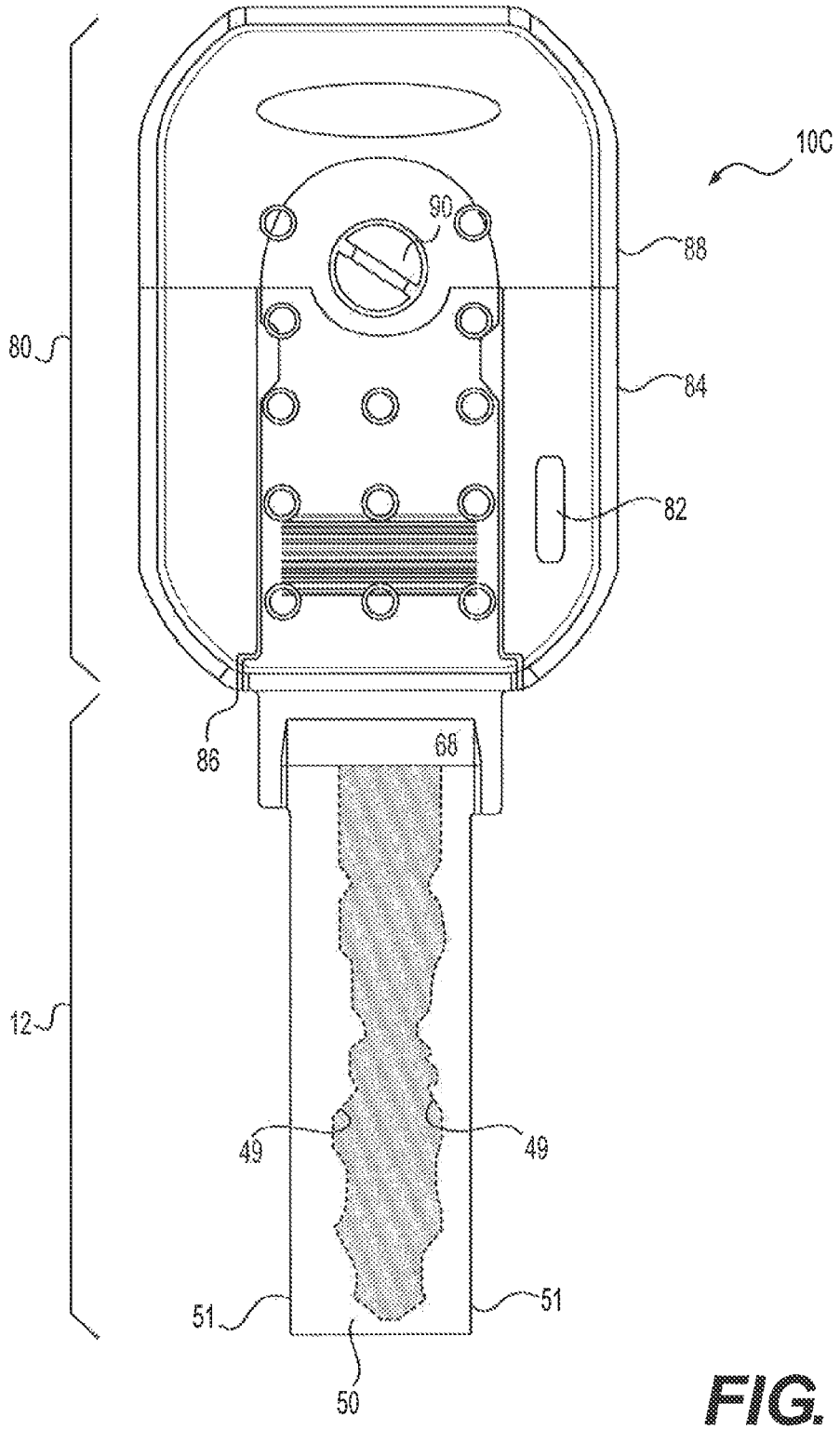
FIG. 4 is a front view illustration of another exemplary disclosed key assembly.

There may be times when removal head 14 from key blade 12 without causing damage to head 14 is desirable. For example, when notches 49 have not been properly fabricated within key blade 12 and/or when damage to key blade 12 has occurred, it may be desirable to remove head 14 and reuse head 14 with another key blade. This may be particularly true when head 14 is a transponder head, which is generally more expensive than a standard or non-transponder head. FIG. 4 illustrates an exemplary embodiment of key assembly 10 (e.g., 10*c*) having a transponder head 80 connected to key blade 12. In this embodiment, transponder head 80 is a two-piece component having a transponder chip 82 removably or fixedly contained inside. Specifically, transponder head 80 may include a lower component 84 having an opening 86 to receive head portion 16 of key blade 12 (shank-first), and an upper component 88 configured to mate with lower component 88 and thereby inhibit removal of key blade 12. Transponder chip 82 may be located within either of lower or upper components 84, 88, as desired. A fastener (e.g., a screw, a clip, etc) 90 may connect upper component 88 to lower component 84. It should be noted that other removable head designs having transponder chips 82 may be utilized together with key blade 12.

Figure 5:
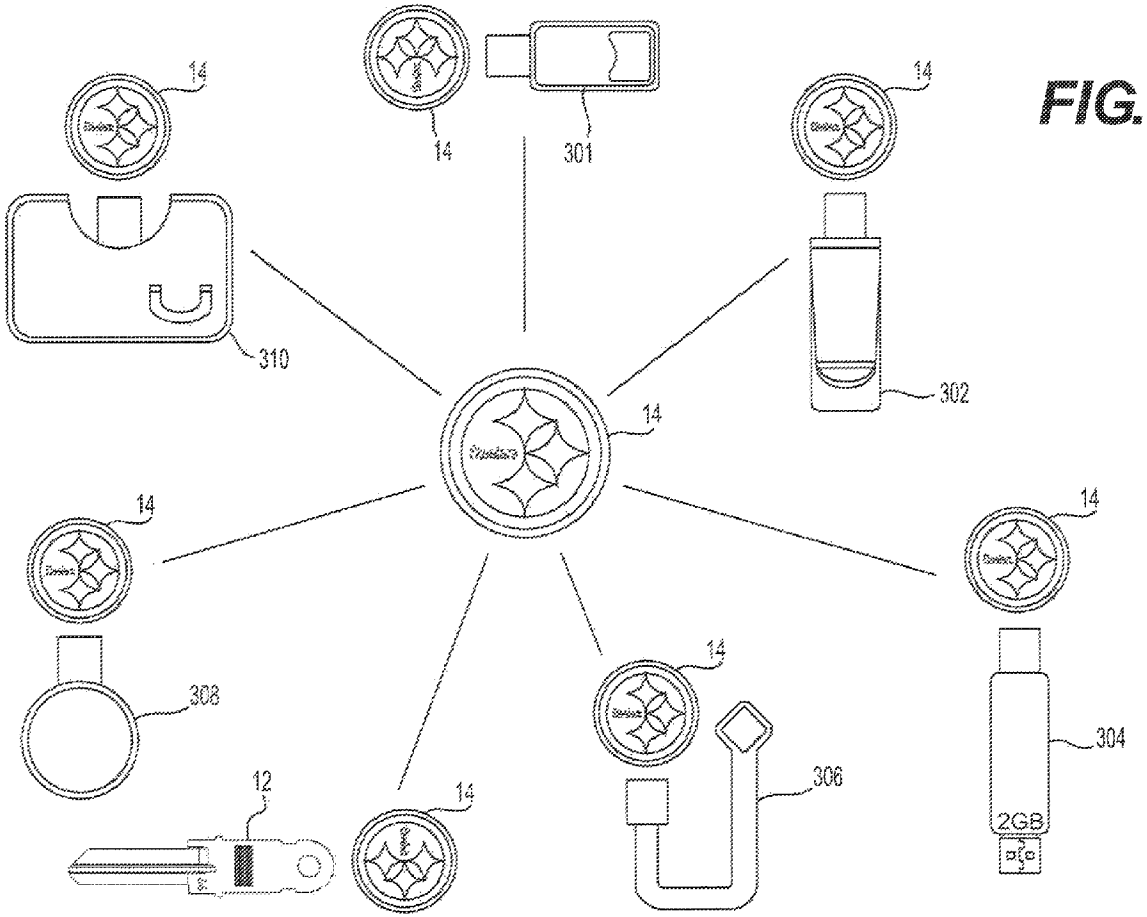
FIG. 5 is a top view illustration of an exemplary disclosed inventory system of consumer-oriented handheld components.

FIG. 5 shows alternative uses of head 14 within an inventory system of consumer-oriented handheld components. In particular it may be profitable to design head 14 to receive items other than just blade 12. For example, hand-held consumer-oriented items or utensils, such as a bottle opener 301, a money clip 302, a portable media drive 304, a purse hook 306, a key ring 308, and a refrigerator magnet 310, may be fabricated with geometry similar to the geometry of head portion 16 of key blade 12, such that these items can accept and lock together with head 14 in the same manner described above. It is contemplated that these items may be purchased along with head 14 and blade 12 at a point of sale. In one embodiment, head 14 may even be customized at the point of sale, for example head 14 may be decorative in nature and printed on, etched, milled, applied with an adhesive backing, etc, to bear a desired shape, symbol, logo, and/or image.

Figure 7:
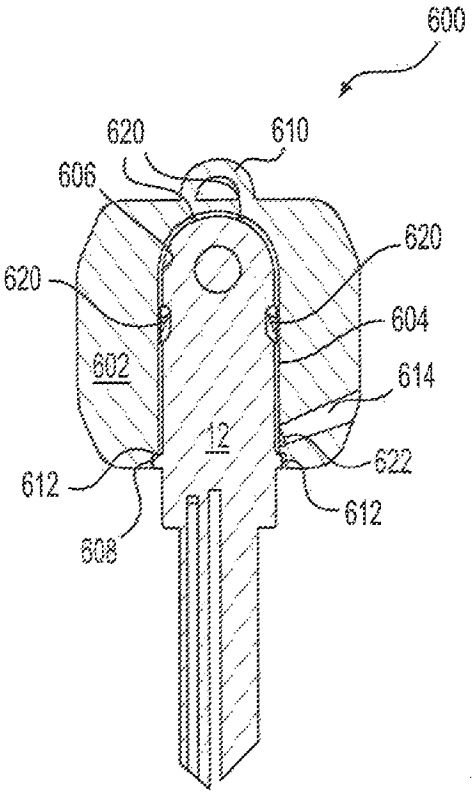
FIGS. 6 and 7 are isometric exploded and front cross-sectional view illustrations of an exemplary disclosed key assembly.
Figure 6:
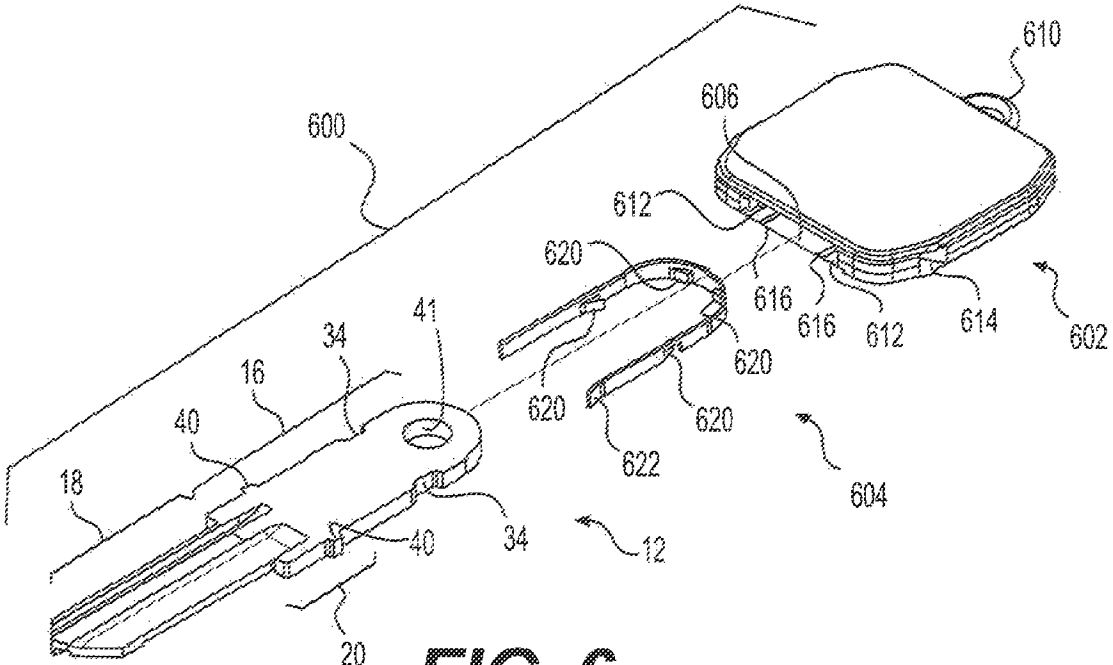

FIGS. 6 and 7 illustrate another key assembly embodiment. In particular, key assembly 600 shown in FIGS. 6 and 7 may include the same key blade 12 described above, a different type of head 602, and a separate locking feature 604 that is used to secure head 602 to key blade 12. In this embodiment, head 602 is fabricated from a material that is not easily injection molded, for example from metal. Because of the fabrication requirements of the material, locking geometry may be difficult to integrally form inside of head 602. Accordingly, locking feature 604 may be separate from head 602 to simplify the manufacturing process.

As seen in FIGS. 6 and 7, head 602 may include a cavity 606 having an opening 608 at only one end that is configured to slidingly receive head portion 16 of blade 12. Like the head designs of FIGS. 1-5, head 602 may include two primary interior surfaces and two side surfaces that are substantially perpendicular to the primary interior surfaces to form cavity 606. In this arrangement, no subassembly of head 602 is required and no corresponding connecting features (i.e., pins or bores) are formed within head 602. Blade 12, when fully assembled, may extend from head 602 only through opening 608, and an accessory engagement feature (e.g., an eyelet) 610 may be formed at an opposing end to engage a separately purchased accessory (e.g., a key ring—not shown).

Different features may be fabricated within head 602 to facilitate connection with blade 12. For example, steps 612 may be formed within head 602 at opening 608 and configured to engage shoulders 40 of blade 12, thereby positioning head 602 at a desired location along blade 12. In addition, an opening 614 may be formed within one of the side surfaces of cavity 606 and configured to interact with locking feature 604 (explained in more detail below). In the disclosed embodiment, opening 614 extends from cavity 606 completely through the side surface of cavity 606 to an exterior of head 602. This extension may facilitate manufacture of opening 614 (e.g., allowing opening 614 to be formed from the outside) and/or provide a way to release locking feature 604. It is contemplated that opening 614 could alternatively embody a close-ended recess, if desired. Further, in some embodiments, two openings 614 may exist, one in each of the opposing side surfaces of cavity 606. The two openings 614 could increase the locking force connecting blade 12 to head 602 or allow for simplified assembly that doesn't require alignment of locking feature 604 with a particular side surface of cavity 606.

Head 602 may also include one or more ribs 616 (shown only in FIG. 6) that enhance the connection of head 602 to blade 12. Ribs 616 may be arranged in spaced-apart pairs that extend from each primary surface inside cavity 60 run in a general lengthwise direction. A spacing between opposing pairs of ribs 616 may be less than the thickness t (referring to FIG. 2B) of head portion 16 of key blade 12, such that ribs 616 compress and/or deform slightly during insertion of key blade 12 into head 602 between the pairs of ribs 616. This compression may generate a force that essentially clamps head portion 16 inside head 602.

Locking feature 604 may be configured to positively engage both head 602 and head portion 16 of key blade 12. In the embodiment of FIGS. 6 and 7, locking feature 604 is a generally U-shaped component fabricated from spring steel and includes a plurality of internal tangs 620 and at least one external tang 622. Internal tangs 620 may be configured to engage head portion 16, while external tang 622 may be configured to engage opening 614 of head 602.

For example, two internal tangs 620 (one located at each side of locking feature 604) may be located to engage recesses 34 in a manner similar to tangs 70 (referring to FIGS. 3A-3B) described above. In particular, tangs 620 may deflect outward out of the way during insertion of head portion 16 into locking feature 604, and then spring back inward upon further insertion to a less-deflected state inside recesses 34. Once internal tangs 620 are inside recesses 34, removal of head portion 16 from locking feature 604 may be mechanically inhibited by engagement of tangs 620 with upper end walls of recesses 34.

Two additional internal tangs 620 located at a curved end of the U-shape of locking feature 604 may be used to apply constant pressure against head portion 16 once head portion 16 is inserted fully into locking feature 604. In particular, the two internal tangs 620 located at the curved end may be at least partially deflected during the insertion of head portion 16 and remain in a deflected state thereafter, such that internal tangs 620 exert a pressure against the curved end of head portion 16. This pressure may function to urge head portion 16 into continuous positive engagement with the two side-located tangs 620 described above such that little, if any, movement between key blade 12 and head 602 is noticeable by the customer.

In the disclosed embodiment, only one external tang 622 is shown and associated with a single leg of the U-shaped locking feature 604. This external tang 622 may deflect out of the way during insertion of locking feature 604 into head 602, and then spring back outward to a less-deflected state inside opening 614 upon further insertion. Once inside opening 614, removal of locking feature 604 may be mechanically inhibited by engagement of external tang 622 with a lower end wall of opening 614. However, it may be possible to insert a removal tool from outside of head 602 through opening 614 to push external tang 622 inward by an amount that allows removal of locking feature 604 from head 602. As described above, it may also be possible for locking feature 604 to include two external tangs 622 (one associated with the distal tip of each leg of the U-shape) to engage two openings 614 located in the opposing side walls of cavity 606, if desired. Further, it may be possible for more than one external tang 622 to be associated with each individual leg of the U-shape. Locking feature 604 may first be inserted into head 602 and then head portion 16 of key blade 12 inserted into locking feature 604 or, alternatively, head portion 16 may first be inserted into locking feature 604 and then locking feature 604 inserted into head 602, as desired.

Figure 8:
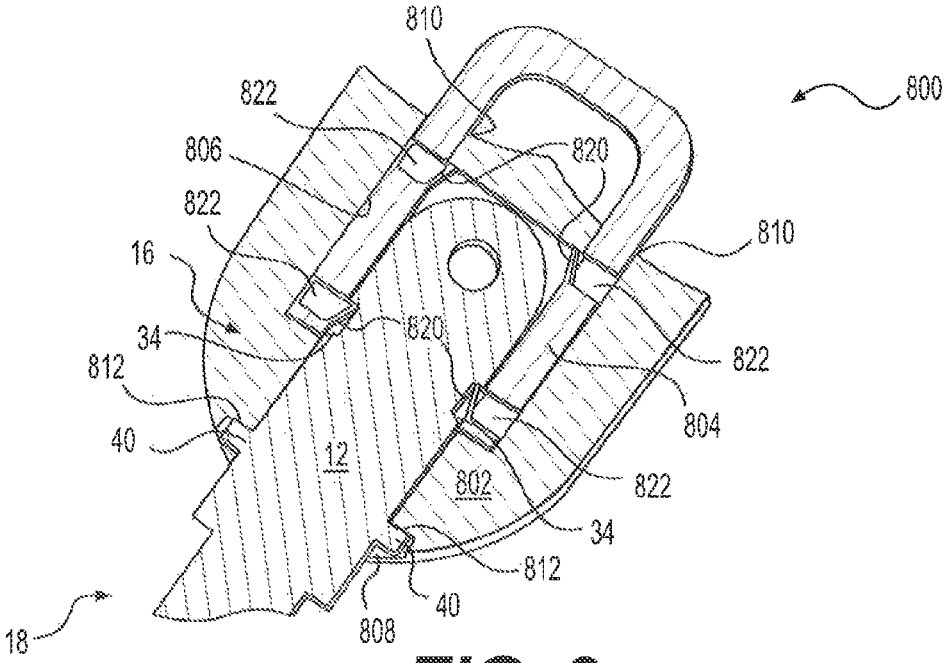
FIGS. 8, 9, 10A, 10B, and 11 are isometric cutaway view illustrations of exemplary disclosed key assemblies.

FIG. 8 illustrates another key assembly embodiment that is similar to the embodiment of FIGS. 6 and 7. In particular, key assembly 800 shown in FIG. 8 may include the same key blade 12 described above, a different type of head 802, and a different locking feature 804 that is used to secure head 802 to key blade 12. Like head 602, head 802 may also be fabricated from a metallic material, requiring locking feature 804 to be separate from head 802. In this embodiment, however, locking feature 804 is inserted into head 802 from an end opposite key blade 12.

Head 802 may include a cavity 806 having a first opening 808 that is configured to slidingly receive head portion 16 of blade 12, and a pair of second openings 810 that are configured to receive legs of locking feature 804 at an opposing end. Like the head design of FIGS. 6 and 7, head 802 may include two primary interior surfaces and two side surface that are substantially perpendicular to the primary interior surfaces to form cavity 806, and no subassembly of head 802 is required. Blade 12, when fully assembled, may extend from head 802 only through opening 808, and locking feature 804 may extend from head 802 only through openings 810. In the disclosed example, locking feature 804 also functions as an accessory engagement feature (e.g., an eyelet) that engages a separately purchased accessory (e.g., a key ring—not shown). Like head 602, head 802 may also include steps 812 formed within head 802 at opening 808 configured to engage shoulders 40 of blade 12, and one or more ribs (not shown) that enhance the connection of head 802 to blade 12.

Locking feature 804 may be configured to positively engage both head 802 and head portion 16 of key blade 12. Like the embodiment of FIGS. 6 and 7, locking feature 804 may be a generally U-shaped component fabricated from spring steel that includes a plurality of internal tangs 820. Internal tangs 820 may be configured to engage head portion 16 at recesses 34 and head 802 at openings 810.

For example, two internal tangs 820 (one located at the distal tip of each lea of locking feature 804) may be configured to engage recesses 34 in a manner similar to tangs 620 (referring to FIGS. 6 and 7) described above. In particular, tangs 820 may deflect outward out of the way (e.g., into pockets 822 formed in each leg of locking feature 804) during insertion of head portion 16 into head 802, and then spring back inward upon further insertion to a less-deflected state inside recesses 34. Once internal tangs 820 are inside recesses 34, removal of head portion 16 from locking feature 804 may be mechanically inhibited by engagement of tangs 820 with the upper end walls of recesses 34.

Two additional internal tangs 820 located just inside of openings 810 (e.g., at a mid location of the legs of locking feature 804) may be used to secure locking feature 804 to head 802. These internal tangs 820 may deflect outward out of the way (e.g., into pockets 822) during insertion of locking feature 804 into head 802, and then spring back inward to a less-deflected state inside cavity 806 upon further insertion. Once inside cavity 806, removal of locking feature 804 may be mechanically inhibited by engagement of internal tangs 820 with an upper end wall of cavity 806. Locking feature 804 may first be inserted into head 802 and then head portion 16 of key blade 12 inserted into locking feature 804 or, alternatively, head portion 16 may first be inserted into head 802 and then locking feature 804 inserted into head 802, as desired.

Figure 9:
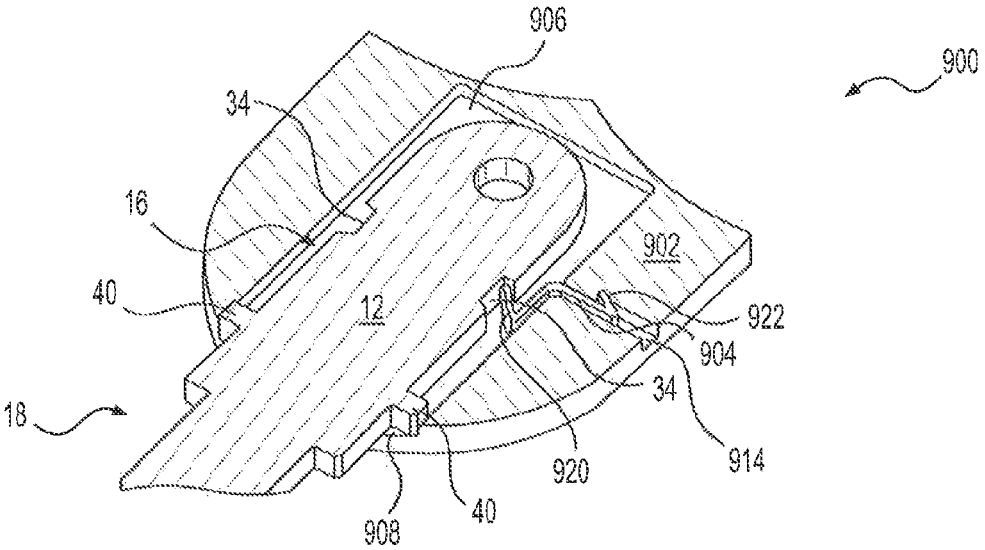

FIG. 9 illustrates another key assembly embodiment that is similar to the embodiment of FIG. 8. In particular, key assembly 900 shown in FIG. 9 may include the same key blade 12 described above, a different type of head 902, and a different locking feature 904 that is used to secure head 902 to key blade 12. Like head 802, head 902 may also be fabricated from a metallic material, requiring locking feature 904 to be separate from head 902. In this embodiment, however, locking feature 904 is inserted into head 902 from the same end as key blade 12, similar to the embodiment of FIGS. 6 and 7.

Head 902 may include a cavity 906 having an opening 908 at only one end that is configured to slidingly receive head portion 16 of blade 12. Like the head design of FIG. 8, head 902 may include two primary interior surfaces and two side surface that are substantially perpendicular to the primary interior surfaces to form cavity 906, and no subassembly of head 902 is required. Blade 12, when fully assembled, may extend from head 902 only through opening 908, and locking feature 904 may not extend from head 902. In the disclosed example, no accessory engagement feature (e.g., an eyelet) is provided, although such a feature may be possible. Unlike head 802, head 902 may not include steps that engage shoulders 40 of blade 12 to position blade 12. Instead, the rounded tip end of head portion 16 may abut an end surface of cavity 906, thereby providing for the proper placement of key blade 12. One or more ribs (not shown) may extend from the primary surfaces of head 902 inside cavity 906 to enhance the connection of head 902 to blade 12, if desired.

Different features may be fabricated within head 902 to facilitate connection with blade 12. For example, an opening 914 may be formed within one of the side surfaces of cavity 906 and configured to interact with locking feature 904. In the disclosed embodiment, opening 914 extends from cavity 906 completely through the side surface of cavity 906 to an exterior of head 902. This extension may facilitate manufacture of opening 914 (e.g., allowing opening 914 to be formed from the outside) and/or provide a way to release locking feature 904. It is contemplated that opening 914 could alternatively embody a close-ended recess, if desired. Further, in some embodiments, two openings 914 may exist, one in each of the opposing side surfaces of cavity 906. The two openings 914 could increase the locking force connecting blade 12 to head 902 or allow for simplified assembly that doesn't require alignment of the locking feature 904 with a particular side surface of cavity 906.

Locking feature 904 may be configured to positively engage both head 902 and head portion 16 of key blade 12. In this embodiment, locking feature 904 is a generally W-shaped component fabricated from spring steel that includes a first tang 920 located at an inboard end and a second tang 922 located at an outboard end. Tang 920 may be configured to engage recess 34 in head portion 16, while tang 922 may be configured to engage opening 914 of head 902. Tang 922 may deflect inward out of the way during insertion of head portion 16 into head 902, and then spring back outward upon further insertion to a less-deflected state inside recesses 34. Once tang 920 is inside recess 34, removal of head portion 16 from head 902 may be mechanically inhibited by engagement of tang 920 with the upper end wall of recess 34. Tang 922 may at least partially deflect during insertion into opening 914, and remain in a deflected state thereafter, such that tang 922 exerts a continuous pressure against the walls of opening 914. This pressure may function to keep locking feature 904 in place inside head 902.

In the disclosed embodiment of FIG. 9, only one locking feature 904 is shown. However, it may be possible for two locking features 904 (one associated with each side of cavity 906 and each side of key blade 12) to be used, if desired. Locking feature 904 may first be inserted into head 902 and then head portion 16 of key blade 12 inserted into head 902 or, alternatively, head portion 16 may first be inserted into head 902 and then locking feature 904 inserted through opening 914 into head 902 and recess 34 of head portion 16, as desired.

Figure 10A:
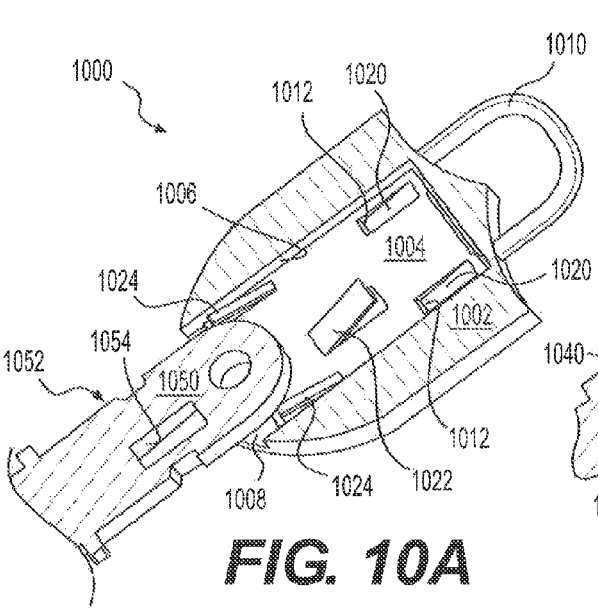
Figure 10B:
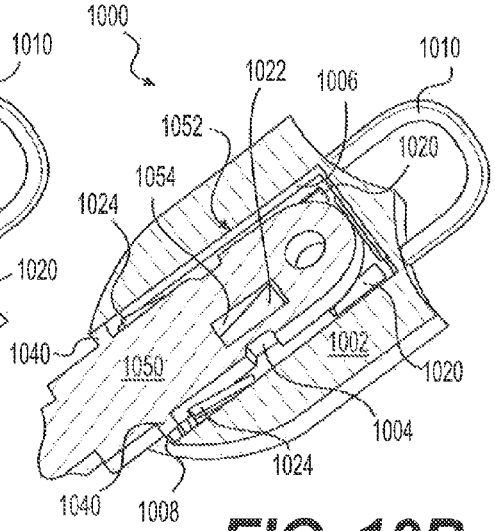

FIGS. 10A and 10B illustrate another key assembly embodiment. In particular, key assembly 1000 shown in FIGS. 10A and 10B may include a key blade 1050 that is slightly different than key blade 12 described above, a different type of head 1002, and a locking feature 1004 that is used to secure head 1002 to key blade 1050. In this embodiment, head 1002 may be fabricated from a material that is not easily injectable, for example from metal. Because of the fabrication requirements of the material, locking geometry may be difficult to integrally form inside head 1002. Accordingly, locking feature 1004, being separate from head 1002, may be used for this purpose.

As seen in FIGS. 10A and 10B, head 1002 may include a cavity 1006 having an opening 1008 at only one end that is configured to slidingly receive a head portion 1052 of blade 1050. Like the head design of FIG. 9, head 1002 may include two primary interior surfaces and two side surface that are substantially perpendicular to the primary interior surfaces to form cavity 1006. In this arrangement, no subassembly of head 1.002 is required and no corresponding connecting features (i.e., pins or bores) are formed within head 1002. Blade 1050, when fully assembled, may extend from head 1002 only through opening 1008, and an accessory engagement feature (e.g., an eyelet) 1010 may be formed at an opposing tip end to engage a separately purchased accessory (e.g., a key ring—not shown).

Different features may be fabricated within head 1002 to facilitate connection with blade 1050. For example, steps 1012 may be formed within one primary surface of head 1002 at an end opposite opening 1008. Steps 1012 may be configured to engage locking feature 1004 (as will be explained in more detail below), thereby retaining locking feature 1004 at a desired location inside cavity 1006. Head 1002 may also include one or more ribs (not shown) that enhance the connection of head 1002 to blade 1050 and/or locking feature 1004.

Locking feature 1004 may be configured to positively engage both head 1002 and head portion 1052 of key blade 1050. In the embodiment of FIGS. 10A and 10B, locking feature 1004 is a generally flat, plate-like component fabricated from spring steel that includes a plurality of tangs extending from opposing sides. The tangs may include one or more first-side tangs 1020 that extend from a first side of locking feature 1004 to engage steps 1012 inside cavity 1006, and one or more second-side tangs 1022 that extend from a second side of locking feature 1004 to engage features of head portion 1052. Tangs 1020 may deflect inward out of the way during insertion of locking feature 1004 into head 1002, and then spring back outward upon further insertion to a less-deflected state inside steps 1012. Once tangs 1020 are inside steps 1012, removal of locking feature 1004 from head 1002 may be inhibited by engagement of tangs 1020 with lower end walls of steps 1012. In a similar manner, tang 1022 may deflect inward out of the way during insertion of head portion 1052 into head 1002, and then spring back outward upon further insertion to a less-deflected state inside a central opening 1054 of head portion 1052. Once tang 1022 is inside opening 1054, removal of head portion 1052 from head 1002 may be mechanically inhibited by engagement of tang 1022 with an upper end wall of opening 1054. Although only a single tang 1022 is used to secure head portion 1052 inside head 1002 in the embodiment of FIGS. 10A and 10B, any number of tangs 1022 could be used for this purpose.

Two additional tangs 1024 located at an end of locking feature 1004 opposite tangs 1020 may be used to position head portion 1052 inside cavity 1006. In particular, the two tangs 1024 may be located to engage shoulders 1040 in the same way that steps 812 engage shoulders 40 in the embodiment of FIG. 8. In this way, the insertion depth of head portion 1052 into cavity 1006 may be limited by tangs 1024. It is also contemplated that tangs 1024 could apply a constant pressure on head portion 1054, much in the same way that tangs 620 do in the embodiment of FIG. 6, if desired.

Figure 11:
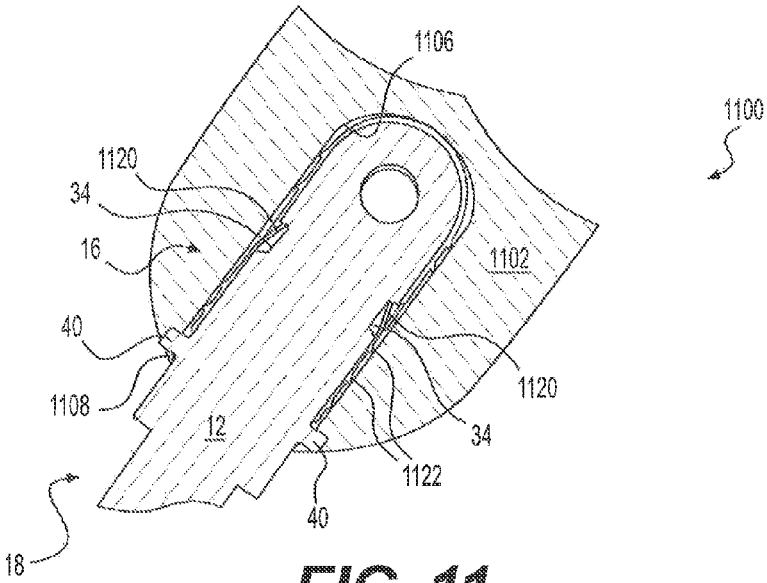

FIG. 11 illustrates another key assembly embodiment that is similar to the embodiment of FIG. 6. In particular, key assembly 1100 shown in FIG. 11 may include the same key blade 12 described above, a different type of head 1102, and a different locking feature 1104 that is used to secure head 1102 to key blade 12. Like head 602, head 1102 may also be fabricated from a metallic material, requiring locking feature 1104 to be separate from head 1102.

Head 1102 may include a cavity 1106 having an opening 1108 at only one end that is configured to slidingly receive head portion 16 of blade 12. Like the head design of FIG. 6, head 1102 may include two primary interior surfaces and two side surface that are substantially perpendicular to the primary interior surfaces to form cavity 1106, and no subassembly of head 1102 is required. Blade 12, when fully assembled, may extend from head 1102 only through opening 1108, and locking feature 1104 may not extend from head 1102. In the disclosed example, no accessory engagement feature (e.g., an eyelet) is provided, although such a feature may be possible. One or more ribs (not shown) may extend from the primary surfaces of head 1102 inside cavity 1106 to enhance the connection of head 1102 to blade 12, if desired.

Locking feature 1104 may be configured to positively engage head portion 16 of key blade 12 and only frictionally engage head 1102. In this embodiment, locking feature 1104 is a generally U-shaped component fabricated from spring steel that includes one or more internal tangs 1120 and a plurality of externally located friction elements (e.g., tangs, bumps, ridges, etc.) 1122. Internal tangs 1120 may be configured to engage head portion 16, while friction elements 1122 may be configured to press against the sides of cavity 1106.

For example, two internal tangs 1120 (one located at each side of locking feature 1104) may be located to engage recesses 34 in a manner similar to tangs 620 (referring to FIGS. 6 and 7) described above. In particular, tangs 1120 may deflect outward out of the way during insertion of head portion 16 into locking feature 1104, and then spring back inward upon further insertion to a less-deflected state inside recesses 34. Once internal tangs 1120 are inside recesses 34, removal of head portion 16 from locking feature 1104 may be mechanically inhibited by engagement of tangs 1120 with upper end walls of recesses 34.

In the disclosed embodiment, multiple external friction elements 1122 are shown and associated with an outer periphery of the U-shaped locking feature 1104. These friction elements 1122 may deflect inward out of the way during insertion of locking feature 1104 into head 1102, and then press back outward against the walls of cavity 1106. This pressure against the walls of cavity 1106 may resist removal of locking feature 604 and head portion 16 from cavity 1106.

Industrial Applicability

The disclosed key assemblies may be utilized for duplicating a single edge-cut key, a dual edge-cut key, and a side-milled key. The disclosed key assemblies may be easy to use and facilitate accurate duplication with a reduced number of miscuts. An exemplary duplication process using the disclosed key assembly will now be described in detail.

To begin the fabrication process (i.e., the process of creating notches 49 within key blade 12), a customer or sales associate must identify the master key to be duplicated. This identification may be completed manually or automatically, and include a type of lock to which the key corresponds; a year, make, or model of the corresponding application; a known or measured notch pattern; and/or a type, size, shape, or model of the corresponding key blank. Based on this information, a key blade 12 that should be used in the fabrication process may be selected. This selection may be performed manually or automatically, as desired.

Once the appropriate key blade 12 corresponding to the master key has been selected, the key blade 12 may be retrieved from inventory and cut to have notches 49 that correspond with the notch pattern of the master key. In some instances, the identity of the retrieved key blade 12 may be confirmed before cutting may begin. And this confirmation may be done in several different ways. In one application, a store sales associate (or the end user or customer themselves) may compare index 42 (referring to FIGS. 1-5) of the retrieved key blade 12 with the intended index 42 of the selected key blade 12. For example, the key blade 12 selected based on the identification information of the master key may be a key type #66. In this example, the store sales associate may ensure that index 42 of the retrieved key blade 12 has #66 stamped therein. In another application, identity confirmation of the retrieved key blade 12 may be performed automatically by a duplication machine (not shown). For example, the duplication machine may detect index 44 (e.g., the barcode printed on or otherwise applied to head portion 16 as a decal, a tag, a label, chemical etching, a sleeve, etc.), identify the retrieved key blade 12 based on stored information corresponding to the detected index 44, and compare the identity with the intended identity of the selected key blade 12.

After the identity of the retrieved key blade 12 has been confirmed, fabrication of notches 49 may begin. In manual processes, the retrieved key blade 12 may be manually mounted within a clamp and then positioned to engage a cutting wheel and/or a milling head. And during this process, key blade 12 may be manually moved relative to the cutting wheel and/or milling head in such a way that the desired notch pattern is created within blade 12. This may be performed, for example, using a tracing apparatus in association with a master key. It is also contemplated that the cutting wheel and/or milling head could alternatively be held stationary, and key blade 12 moved to cut the notch pattern, if desired.

In an automated cutting process, the retrieved key blade 12 may be inserted into a cutting module of a duplication machine. In some instances, only shank 18 may need to be inserted into the cutting module. In other instances, all of key blade 12 may need to be inserted. Regardless of the configuration of the particular cutting module, index 44 may be used to facilitate the cutting process. For example, a scanner, camera, or other detection device may be located to detect the barcode of index 44 once key blade 12 (or only shank 18) has been inserted into the cutting module. In some instances, this detection may be part of the identity confirmation step described above. In other instances, this detection may be an additional step.

Detection of index 44 within the cutting module may be used to confirm that key blade 12 has been inserted properly into the cutting module. For example, the barcode of index 44 may be located on only one side of key blade 12. And when index 44 is not detected upon insertion of key blade 12, it may be concluded that key blade 12 is not inserted properly. Improper insertion may include not fully inserting key blade 12 or inserting key blade 12 upside-down. When this occurs, key blade 12 may need to be pushed in further or pulled out and turned over.

The information encoded within index 44 may be used by an automated key fabrication machine to cut the desired pattern of notches 49. For example, the information encoded within the barcode of index 44 may include the identity of key blade 12, geometry of key blade 12 (e.g., size, shape, material, etc.), and/or clamping requirements (location, orientation, position, force, etc.) of key blade 12. This information may be deciphered by the cutting module of the automated fabrication machine, and used to set up the machine in such a way that allows proper cutting of key blade 12.

Before, during, and after the cutting process has been completed, a sales transaction associated with the cutting process may be completed. This sales transaction may include using the barcode of index 44 to determine the key blade 12 used for the process, a type of cutting process involved (e.g., cutting or milling), a corresponding reduction in key blade inventory, and/or a cost of the transaction. For example, the sales associate may scan the bar code on head portion 16, and charge the customer a corresponding amount at a point of sale. At this same time, the customer may also choose and pay for a corresponding head 14. Thereafter, the sales associate or the customer may assemble head 14 (or any one of heads 602, 802, 902 1002, and 1102) to key blade 12, by pushing end 66 of head 14 over tip end 24 of head portion 16 and, in some instances, pushing a locking feature (e.g., one of locking features 604, 804, 904, 1004, and 1104) into place between the selected head 14 and head portion 16. Head 14 may be assembled to key blade 12 in only a single direction (i.e., head-first) and in two different orientations (e.g., a front orientation and a back orientation) that are 180° rotated from each other about a length direction of key blade 12.

The disclosed key assembly may be inexpensive to fabricate, simple to assembly, and provide for head/blade interchangeability. Specifically, with key blades 12 being stamped and head 14 being molded, the cost of fabrication may be reduced, in addition, a common or universal key blade 12 may be used to make many different types, styles, and sizes of keys. And likewise, head 14 may be used on many different key blades 12. This commonality may help to keep the number of different key blades 12 and heads 14 low and the volume high, which further reduces component cost. Further, because head 14 can be connected to key blade 12 simply by pushing head 14 over head portion 16, the time and effort associated with assembly may be low. And the low cost nature and commonality of head 14 and the ease of assembly may allow for the customer to choose from many different styles, configurations, and/or colors of heads to be used with any key blade 12.

In addition, because head 14 may be universal and can be connected to any key blade 12, the customer may he provided with greater variety. Specifically, a greater assortment of different head designs may be provided with reduced inventory, as each different head 14 can fit any key blade 12. Instead of having to make dozens of different key heads each having the same logo or design that fit dozens of different key blades, one head may be created that fits all key blades 12; and each head 14 may have a different logo. Thus a greater variety of heads 14 may be created and stocked in inventory for use by the customer. And by having multiple different subsets of heads, including removable heads, non-removable heads, injectable heads, and metallic heads all able to connect to the same type of key blade, a cost of an associated key blank inventory system may be small.

It will be apparent to those skilled in the art that various modifications and variations can be made to the disclosed key assemblies. Other embodiments will be apparent to those skilled in the art from consideration of the specification and practice of the disclosed key assemblies. It is intended that the specification and examples be considered as exemplary only, with a true scope being indicated by the following claims and their equivalents.

What is claimed is:

1. A key assembly, comprising:

a blade;

a head configured to receive the blade; and a locking feature separate from the blade and the head and being received by the head, the locking feature configured to inhibit removal of the blade from the head via interference, wherein:

the locking feature deforms during connection to the blade;

the locking feature includes at least one tang that flexes out of the way of the blade during assembly and returns back into a recess of the blade to prevent disengagement; and disengagement of the blade causes destruction of the locking feature.

2. The key assembly of claim 1, wherein the locking feature also deforms during connection to the head.

3. The key assembly of claim 1, wherein the locking feature is also configured to engage an accessory to connect the accessory to the key assembly.

4. The key assembly of claim 1, wherein the at least one tang is configured to engage a center opening in a head portion of the blade.

5. The key assembly of claim 1, wherein the at least one tang is configured to engage a side recess in a head portion of the blade.

6. The key assembly of claim 1, wherein the locking feature is generally U-shaped and configured to receive a head portion of the blade.

7. The key assembly of claim 6, wherein the U-shape of the locking feature includes legs separately received within two different openings in the head.

8. The key assembly of claim 1, wherein the head includes steps that engage shoulders of the blade to limit an insertion depth.

9. The key assembly of claim 1, wherein the locking feature further includes geometry that engage shoulders of the blade, which extend outward past edges of the blade and the head, to limit an insertion depth of the blade into the head.

10. The key assembly of claim 9, wherein the geometry includes at least one additional tang.

11. The key assembly of claim 1, wherein the locking feature is generally W-shaped.

12. The key assembly of claim 11, wherein the locking feature is configured to engage an opening formed in a sidewall of central cavity in the head and a recess in a side of the blade.

13. The key assembly of claim 1, wherein:
the blade is fabricated from a first metal;
the head is fabricated from plastic; and
the locking feature is fabricated from a second metal different from the first metal.

14. The key assembly of claim 13, wherein:
the first metal is one of aluminum, brass, or bronze; and
the second metal is spring steel.

15. A key assembly, comprising:
a blade;
a head configured to receive the blade; and
a locking feature separate from the blade and the head and being received by the head, the locking feature configured to inhibit removal of the blade from the head via interference, wherein:
the locking feature deforms during connection to the blade;
the locking feature includes at least one tang that flexes out of the way of the blade during assembly and returns back into a recess of the blade to prevent disengagement; and
the at least one tang includes two tangs that separately engage two different recesses in a head portion of the blade.

16. The key assembly of claim 15, further including at least one additional tang configured to exert continuous pressure on the head portion of the blade urging the head portion of the blade into further engagement with the two tangs.

17. A key assembly, comprising:
a blade;
a head configured to receive the blade; and
a locking feature separate from the blade and the head and being received by the head, the locking feature configured to inhibit removal of the blade from the head via interference, wherein:
the locking feature deforms during connection to the blade;
the locking feature includes at least one tang that flexes out of the way of the blade during assembly and returns back into a recess of the to prevent disengagement;
the at least one tang includes at least a first tang configured to engage a head portion of the blade; and
the locking feature further includes at least a second tang configured to engage the head.

18. The key assembly of claim 17, wherein:
the head includes an internal cavity; and
the at least a second tang is configured to engage an opening formed in a side wall of the internal cavity.

19. The key assembly of claim 17, wherein:
the head includes an internal cavity; and
the at least a second tang is configured to only frictionally engage a side wall of the internal cavity after assembly of the blade into the head.

20. The key assembly of claim 17, wherein the at least a second tang includes a plurality of second tangs.

21. The key assembly of claim 17, wherein the at least a first tang includes a plurality of first tangs.

22. A key assembly, comprising:
a blade;
a head configured to receive the blade; and
a locking feature separate from the blade and the head and being received by the head, the locking feature configured to inhibit removal of the blade from the head via interference, wherein the locking feature deforms during connection to the blade, wherein:
the locking feature is generally U-shaped and configured to receive a head portion of the blade;
the locking feature includes legs separately received within two different openings in the head; and
the locking feature includes a single tang located at a distal tip end of one of the legs, the single tang configured to engage a recess in the head.

23. A key assembly, comprising:
a blade;
a head configured to receive the blade; and
a locking feature separate from the blade and the head and being received by the head, the locking feature configured to inhibit removal of the blade from the head via interference, wherein:
the locking feature includes first and second tangs that deform during connection to the blade;
the head includes an opening that receives the blade; and
the locking feature is received in the head through the opening.

24. A key assembly, comprising:
a blade;
a head configured to receive the blade; and
a locking feature separate from the blade and the head and being received by the head, the locking feature configured to inhibit removal of the blade from the head via interference, wherein:
the locking feature deforms during connection to the blade;
the locking feature includes at least one tang that flexes out of the way of the blade during assembly and returns back into a recess of the blade to prevent disengagement;
the head includes a first opening that receives the blade, and a second opening located at an end of the head opposite the first opening; and
the locking feature is received into the head through the second opening.

25. A key assembly, comprising:
a blade having:
a head portion;
a shank;
a transition region connecting the head portion to the shank; and
at least one protrusion located at the transition region and extending outward past side edges of the blade;
a head configured to receive the head portion of the blade and having at least one shoulder configured to engage the at least one protrusion; and
a locking feature separate from the blade and the head, the locking feature received by the head and configured to permanently inhibit removal of the blade from the head.

26. The key assembly of claim 25, wherein the locking feature includes at least one tang that flexes out of the way of the blade during assembly and returns back into a recess of the blade to prevent disengagement.

27. The key assembly of claim 26, wherein the at least one tang includes two tangs that separately engage two different recesses in the head portion of the blade.

28. The key assembly of claim 27, further including at least one additional tang configured to exert continuous pressure on the head portion of the blade urging the head portion of the blade into further engagement with the two tangs.

29. The key assembly of claim 26, wherein the at least one tang is configured to engage a center opening in a head portion of the blade.

30. The key assembly of claim 26 wherein the at least one tang is configured to engage a side recess in a head portion of the blade.

31. The key assembly of claim 26, wherein:
the at least one tang includes at least a first tang configured to engage a head portion of the blade; and the locking feature further includes at least a second tang configured to engage the head.

32. The key assembly of claim 31, wherein:

the head includes an internal cavity; and the at least a second tang is configured to engage an opening formed in a side wall of the internal cavity.

33. The key assembly of claim 31, Wherein:

the head includes an internal cavity; and the at least a second tang is configured to only frictionally engage a side wall of the internal cavity after assembly of the blade into the head.

34. The key assembly of claim 31, wherein the at least a second tang includes a plurality of second tangs.

35. The key assembly of claim 31, wherein the at least a first tang includes a plurality of first tangs.

36. The key assembly of claim 25, wherein the locking feature is generally U-shaped and configured to receive a head portion of the blade.

37. The key assembly of claim 36, wherein the U-shape of the locking feature includes legs separately received within two different openings in the head.

38. The key assembly of claim 37, wherein the locking feature includes a single tang located at a distal tip end of one of the legs, the single tang configured to engage a recess in the head.

39. The key assembly of claim 25, wherein:

the head includes a first opening that receives the blade, and a second opening located at an end of the head opposite the first opening; and the locking feature is received into the head through the second opening.

40. The key assembly of claim 25, wherein the locking feature is generally W-shaped.

41. The key assembly of claim 40, wherein the locking feature is configured to engage an opening formed in a sidewall of central cavity in the head and a recess in a side of the blade.

42. A key assembly, comprising:

a blade;

a head configured to receive the blade; and a locking feature separate from the blade and the head and being receivable by the head, the locking feature having:

at least a first tang configured to engage the blade; and at least a second tang configured to engage the head, wherein the at least a first tang deflects away from the blade during assembly.

43. The key assembly of claim 42, wherein the at least a first and at least a second tangs flex out of the way during assembly and return back to prevent disengagement of the blade from the head.

44. The key assembly of claim 43, wherein the at least a first tang includes two first tangs that separately engage two different recesses in a head portion of the blade.

45. The key assembly of claim 44, further including at least one additional tang configured to exert continuous pressure on the head portion of the blade urging the head portion of the blade into further engagement with the two tangs.

46. The key assembly of claim 42, wherein the at least a first tang is configured to engage a center opening in a head portion of the blade.

47. The key assembly of claim 42, wherein the at least a first tang is configured to engage a side recess in a head portion of the blade.

48. The key assembly of claim 42, wherein:

the head includes an internal cavity; and the at least a second tang is configured to engage an opening formed in a side wall of the internal cavity.

49. The key assembly of claim 42, wherein:

the head includes an internal cavity; and the at least a second tang is configured to frictionally engage a side wall of the internal cavity.

50. The key assembly of claim 42, wherein the at least a second tang includes a plurality of second tangs.

51. The key assembly of claim 50, wherein the at least a first tang includes a plurality of first tangs.

52. The key assembly of claim 42, wherein the locking feature is generally U-shaped and configured to receive a head portion of the blade.

53. The key assembly of claim 42, wherein:

the head includes a first opening that receives the blade, and a second opening located at an end opposite the first opening; and the locking feature is received in the head through the second opening.

54. The key assembly of claim 42, wherein the locking feature is generally W-shaped.

55. A key assembly, comprising:

a blade;

a head configured to receive the blade; and a locking feature separate from the blade and the head and being receivable by the head, the locking feature having:

at least a first tang configured to engage the blade; and at least a second tang configured to engage the head, wherein:

the locking feature is generally U-shaped and configured to receive a head portion of the blade; and the locking feature includes legs separately received within two different openings in the head.

56. The key assembly of claim 55, wherein the at least a second tang includes a single tang located at a distal tip end of one of the legs, the single tang configured to engage a recess in the head.

57. A key assembly, comprising:

a blade;

a head configured to receive the blade; and a locking feature separate from the blade and the head and being receivable by the head, the locking feature having:

at least a first tang configured to engage the blade; and at least a second tang configured to engage the head, wherein:

the head includes an opening that receives the blade; and the locking feature is received in the head through the opening.

58. A key assembly, comprising:

a blade;

a head configured to receive the blade; and a locking feature separate from the blade and the head and being receivable by the head, the locking feature having:

at least a first tang configured to engage the blade; and at least a second tang configured to engage the head, wherein the locking feature is flat and generally plate-like, and inserted into the head from a blade end of the head.

* * * * *